United States Patent [19]

Parks et al.

[11] Patent Number: 4,608,737

[45] Date of Patent: Sep. 2, 1986

[54] MAGNET DEVELOPER ROLLS

[75] Inventors: Dale B. Parks, W. Henrietta; Ronald T. Kosmider, Rochester, both of N.Y.

[73] Assignee: Magnetic Technologies Corp., Rochester, N.Y.

[21] Appl. No.: 642,015

[22] Filed: Aug. 20, 1984

[51] Int. Cl.[4] ..... B21B 13/02; B21B 27/02

[52] U.S. Cl. ..... 29/110; 29/116 R; 29/130; 29/132

[58] Field of Search ..... 118/657, 658, DIG. 15, 118/1; 355/3 DD, 14 D; 29/110, 116 R, 132, 130

[56] References Cited

U.S. PATENT DOCUMENTS

| | | | |
|---|---|---|---|
| 3,152,924 | 10/1969 | Wanielizta et al. | 118/657 X |
| 4,041,901 | 8/1977 | Rarey et al. | 118/658 X |
| 4,142,281 | 3/1979 | Müller | 29/116 R |
| 4,330,193 | 5/1982 | Stange | 355/3 DD |

FOREIGN PATENT DOCUMENTS

| | | | |
|---|---|---|---|
| 26678 | 4/1981 | European Pat. Off. . | |
| 63377 | 10/1982 | European Pat. Off. . | |
| 119154 | 9/1981 | Japan | 355/14 D |
| 8203177 | 9/1982 | World Int. Prop. O. . | |

OTHER PUBLICATIONS

Product Bulletin-SUMIGAUSS; Sumitomo Bakelite Co., Ltd.

Product Bulletin-Koroseal; BF Goodrich Company, Akron, Ohio (FPD-80-FP-1001).

Guide of Permanent Magnets; Cat. No. M1001; Sumitomo Special Metals Co., Ltd. (7/1980).

*Primary Examiner*—Howard N. Goldberg
*Assistant Examiner*—Ronald S. Wallace
*Attorney, Agent, or Firm*—Martin LuKacher

[57] ABSTRACT

A magnet roll for use in a developer unit of an electrostatic copier having a magnet structure provided by elongated bars of permanent magnet material magnetized to provide radially oriented magnets. The bars are sufficiently rigid to support hubs without the need for a core. A cylindrical shell of conductive material is rotatably mounted on the magnet structure by shafts which are either journaled in or on the hubs of the magnet structure. The bars are made of conductive plastic or ceramic or elastomeric material (rubber) having permanent magnet material therein which is polarized to provide magnetic poles along the axis of the cylindrical shell which are magnetized in a radial direction with respect to the axis. The elastomeric (rubber) magnet bars have a rigid (steel) backing. The entire roll may be fabricated, essentially from plastic material and at low cost.

18 Claims, 3 Drawing Figures

MAGNET DEVELOPER ROLLS

DESCRIPTION

The present invention relates to magnet rolls for use in developer units of electrostatic copiers and particularly to magnet rolls which may be fabricated at lower cost than rolls which have heretofore been available.

Magnet rolls are used for the application of toner to a drum or belt containing a latent electrostatic image. Such rolls are constructed from magnets which are mounted on cores. Hubs are rotatably mounted on shafts extending from the cores and support a cylindrical shell. Either the shell or core rotates and toner material is picked up from a sump. The toner is carried to the drum or belt carrying the electrostatic image. Due to the electrostatic potentials, the toner is transferred to the image. The toned image can thereafter be printed out on paper to print a copy of the image. Since a brush of toner is carried by the magnet rolls, these units are sometimes called magnetic brushes. The core is usually a machined metal part. The core and the bearings for supporting the rotating shell are a significant component in the cost of the magnet roll. In an effort to avoid the need for the core, it has been proposed to use a cylindrical body and magnetize it in opposite directions over its surface to provide the magnet poles necessary for formation of the magnetic toner brush. Since magnetic material is expensive, this expedient does not provide any significant cost saving over the use of a core and bearings for the rotating shell.

It is the principal object of the present invention to provide improved magnetic rolls which may be manufactured at low cost by eliminating the need for a core.

It is another object of the present invention to provide improved magnetic rolls which may be manufactured entirely or substantially entirely out of plastic parts so as to be extremely light in weight so as to be especially suitable for use in small, portable copiers as well as very low in cost and especially suitable for use in throw away developer units.

It is a further object of the present invention to provide improved magnetic rolls having a magnet structure where discrete magnets provide the structural bearing members, thereby doing away with the need for a core.

Briefly described, a magnet developer roll in accordance with the invention has a magnet structure and a cylindrical shell of conductive material around the magnet structure. The magnet structure has a plurality of conductive hubs, and a rib (or a plurality of ribs where a plurality of angularly displaced magnet poles is needed). The ribs are plastic or ceramic material, and contain permanent magnet particles polarized radially with respect to the axis of the shell. The ribs are sufficiently rigid to support the conductive hubs in spaced relationship without the presence of a core. The rubber magnets may be backed with rigid strips (e.g., of steel). The hubs and shell are supported for rotation, with respect to each other, about the axis of the shell.

The foregoing and other objects, features and advantages of the invention, and a presently preferred embodiment thereof, will become more apparent from a reading of the following description in connection with accompanying drawings in which.

Figure 1:
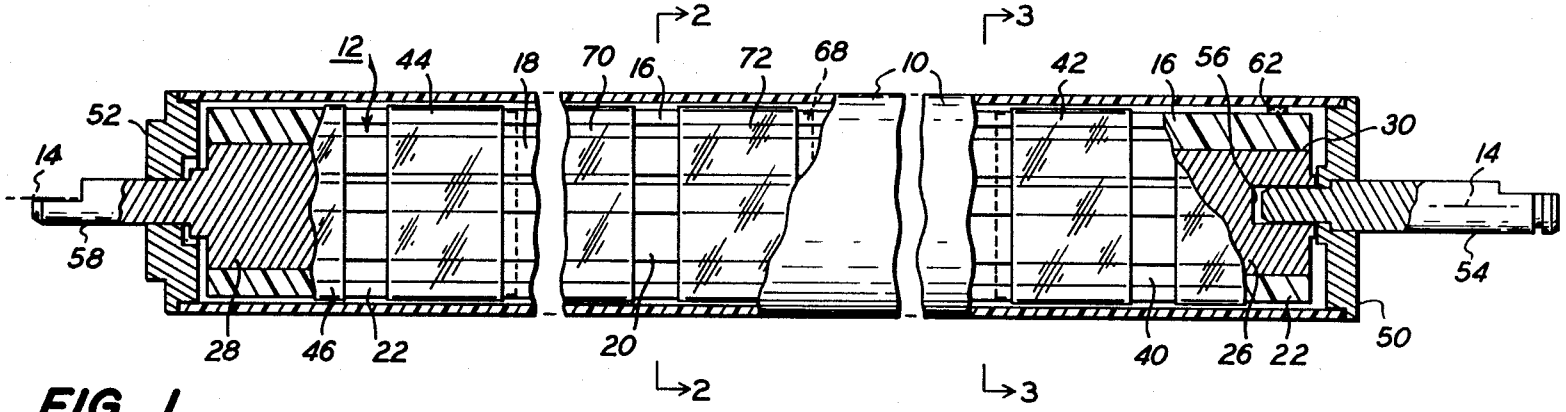
FIG. 1 is a front view of a magnet coil embodying the invention, the view being broken away to illustrate the internal construction of the roll.

Referring more particularly to the drawings, there is shown a cylindrical shell 10, which is preferably made from conductive material. The shell may be extruded from conductive plastic. The shell may be made conductive by plating its exterior and interior surfaces with conductive material (metal) or by spray coating the surfaces with conductive plastic, such as conductive epoxy. Within the shell 10 there is disposed a magnet structure which has, as its structural bearing members, ribs which are magnetically polarized radially with respect to the axis 14 of the shell. This axis 14 is also the longitudinal axis of the entire roll. Five ribs, 16, 18, 20, 22 and 24 are used. These ribs are bars of rectilinear cross section. A rectangular cross section is preferred, since it facilitates the extrusion of these bars. The bars are plastic with particles of magnetic material captured in the resin. The magnets are magnetically oriented or polarized, preferably while the base material (plastic) is solidifying during molding. The bars come out of the mold magnetized. The bars, when assembled in the magnet structure 12, therefore provide magnets which are oriented in the radial direction with respect to the axis 14 over long lengths. A radial rib structure of the magnets 16 to 24 supports, while being held in radial orientation, two end hubs 26 and 28. These hubs are suitably plastic parts made of conductive plastic. Radially disposed and angularly displaced grooves 30, 32, 34, 36 and 38 receive the bars 16, 18, 20, 22 and 24. The bars may be held in assembled relationship with the hubs 26 and 28, simply and expediently by means of adhesive tape. The tape is suitably polyester tape, strips 40, 42, 44 and 46 of which extend around the hubs 26 and 28 and over the bars 16 to 24.

Figure 2:
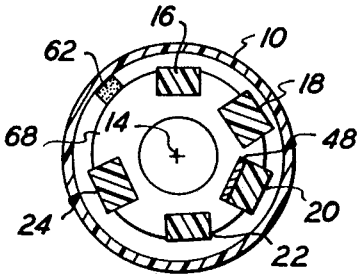
FIG. 2 is a sectional view, taken along the line 2—2 in FIG. 1.
Figure 3:
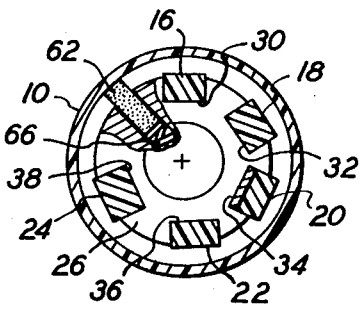
FIG. 3 is another sectional view taken along the line 3—3 in FIG. 1, the view being partially broken away to illustrate the contact brush which is located in one of the hubs of the magnet structure of the roll.

The bars 16 to 24, or one or more of them, may be made of ceramic material in which particles of magnetic material are captured. The magnetic material particles may be magnetized (magnetically polarized in the radial direction with respect to the axis 14) during the molding of the ceramic bars. If additional rigidity or magnetic return paths for the magnet bars are needed, metal strips of soft magnetic material (iron or iron alloy, preferably steel), such as shown at 48 in FIG. 2, may be used. When the magnets used elastomeric material, such as rubber, as the base material, the steel backing is used. Plastic magnet bars are available from Sumitomo Bakelite Co. Ltd. Ceramic magnets are available from Sumitomo Special Metals Co. Ltd. Rubber magnets are available from The B. F. Goodrich Co. The Sumitomo Companies are in Tokyo, Japan and Los Angeles, Calif. B. F. Goodrich is in Akron, Ohio.

The ends of the shell 10 receive hubs 50 and 52. These hubs may also be plastic parts made of conductive plastic material. A shaft 54 is attached to and rotatable with the hub 50. An axial blind hole 56 in the magnetic structure hub 26 provides a journal for the shaft 54. The shaft 54 suitably functions as a drive shaft for rotating the shell 10 while the magnetic structure remains stationary. A shaft 58, which may be an integral part of the other hub 28 of the magnet structure 12, extends through the hub 52 of the shell and provides a journal about which this hub 52 rotates. The shaft 58 may be held stationary (i.e., fixedly mounted) in the developer unit in which the magnet roll is installed. Preferably, the magnetic structure 12 is stationary while the cylindrical shell 10 rotates about the axis 14, driven by the shaft 54 which functions as a drive shaft. The shell may alternatively be held stationary and the magnetic structure 12 rotated, in which event the other shaft 58 becomes the drive shaft, while the shaft 54 is held stationary.

The shaft 54 and the hub 50 may be one integral part, both molded of conductive plastic. A primary current path to the conductive shell 10 is provided through the shaft 54 and the hub 50. A secondary current path may be provided by means of a contactor 62 or brush which is mounted in a radial hole 64 in the hub 26 of the magnet structure. A spring 66 at the closed end of the hole 64 biases the contact brush 62 against the inner periphery of the shell 10.

Optionally, and preferably if the magnetic roll is long, an auxiliary intermediate hub 68 may be used. The intermediate hub 68 may be of a design similar to the end hubs 26 and 28 and the bars 16 to 24 may be assembled thereto by strips 70 and 72 of adhesive tape.

From the foregoing description it will be apparent that there has been provided improved magnet rolls for use in the developer units of electrostatic copiers. While a presently preferred embodiment of the invention has been described, it will be appreciated that variations and modifications thereof within the scope of the invention will suggest themselves to those skilled in the art. Accordingly the foregoing description should be taken as illustrative and not in a limiting sense.

We claim:

1. A magnet development roll which comprises a magnet structure, a cylindrical shell of conductive material around said magnet structure, said shell having an axis, said magnet structure having a plurality of hubs and a plurality of ribs, at least one of said ribs containing permanent magnet material, said ribs being connected to the periphery of said hubs and defining a unitary assembly with said hubs spaced apart and not otherwise connected except by said ribs, said ribs being sufficiently rigid to support said hubs in spaced apart relationship without the presence of a core, the space in said structure between said hubs being completely open except for said ribs, and means supporting said structure on shell for rotation with respect to each other about said access.

2. The magnet developer roll according to claim 1 wherein said plurality of said rigid ribs containing magnetic material polarized radially with respect to the axis of said shell are disposed angularly spaced from each other about said axis.

3. The magnet developer roll according to claim 2 wherein said hubs are disposed at the ends of said ribs, said hubs having radial grooves therein, and said ribs being disposed in said grooves.

4. The magnet developer roll according to claim 3 further comprising strips of adhesive tape around said hubs and ribs holding said ribs in assembled relationship with said hubs.

5. The magnet developer roll according to claim 2 wherein said plurality of hubs comprise a pair of hubs which are disposed, each at an opposite end of said structure in assembled relationship with the ends of said ribs, and another hub disposed in assembled relationship with said ribs intermediate of said pair of hubs, the space between said another hub and said pair of hubs also being completely open except for said hubs.

6. The magnet developer roll according to claim 5 wherein all said hubs have radial grooves therein, said ribs being disposed in said grooves.

7. The magnet developer roll according to claim 6 wherein strips of adhesive tape are disposed around said hubs over said ribs holding said ribs and hubs in assembled relationship with each other.

8. The magnet developer roll according to claim 2 further comprising a further pair of hubs, said further pair of hubs being mounted each in the opposite end of said shell and being rotatable therewith, shafts extending along said axis between said further hubs and the hubs of said magnet structure providing said means supporting said magnet structure and shell for rotation about said axis with respect to each other.

9. The magnet developer roll according to claim 8 wherein one of said shafts is a drive shaft which is rotatable with one of said further hubs and is journaled in the one of said magnet structure hubs adjacent thereto, and wherein the other of said shafts is fixedly connected to the other of said magnetic structure hubs and the other of said further hubs is journaled on the other of said shafts.

10. The magnet developer roll according to claim 9 wherein at least said one magnet structure hub is of conductive material for providing a primary current path to said shell.

11. The magnet developer roll according to claim 10 wherein said drive shaft and said one magnet structure hub is also of conductive material, and a contact member mounted in said one magnetic structure hub and extending radially into contact with the interior surface of such shell to provide a secondary current path to said shell.

12. The magnet developer roll according to claim 1 wherein said at least one rib is a bar of plastic containing permanent magnet material.

13. The magnet developer roll according to claim 1 wherein said at least one rib is a bar of ceramic material containing permanent magnet material.

14. The magnet developer roll according to claim 1 wherein said at least one rib is a bar of elastomeric material containing permanent magnet material, said bar having a backing of a rigid strip of magnetizable material.

15. The magnet developer roll according to claim 2 wherein said ribs are bars of rectilinear cross section and of material selected from plastic material containing permanent magnetic particles and ceramic material containing permanent magnetic particles.

16. The magnet developer roll according to claim 12 wherein said bar has a strip of rigid magnetic metal attached thereto.

17. The magnet developer roll according to claim 13 wherein said bar has a strip of rigid magnetic metal attached thereto.

18. The magnet developer roll according to claim 2 wherein at least one of said bars has a strip of rigid magnetic metal attached thereto.

* * * * *